US007942836B1

(12) United States Patent
Ives

(10) Patent No.: US 7,942,836 B1
(45) Date of Patent: May 17, 2011

(54) MASSAGING AND EXFOLIATING RAZOR COVER APPARATUS AND ASSOCIATED METHOD

(76) Inventor: Karen Lee Ives, George Town, MD (US)

( * ) Notice: Subject to any disclaimer, the term of this patent is extended or adjusted under 35 U.S.C. 154(b) by 0 days.

(21) Appl. No.: 12/796,948

(22) Filed: Jun. 9, 2010

Related U.S. Application Data

(60) Provisional application No. 61/185,222, filed on Jun. 9, 2009.

(51) Int. Cl.
*A61H 7/00* (2006.01)

(52) U.S. Cl. ..... 601/138; 601/137

(58) Field of Classification Search ..... 601/134, 601/135, 136, 137, 138, 139, 140, 141; 606/131; 607/79

See application file for complete search history.

(56) References Cited

U.S. PATENT DOCUMENTS

| | | | | |
|---|---|---|---|---|
| 2,103,083 | A * | 12/1937 | Lynch | 601/139 |
| 2,253,910 | A * | 8/1941 | Luenz | 601/139 |
| 4,438,767 | A | 3/1984 | Nelson | |
| 4,590,926 | A | 5/1986 | Courtin | |
| 5,382,222 | A | 1/1995 | Yih-Jong | |
| 5,403,534 | A | 4/1995 | Kim | |
| D535,033 | S | 1/2007 | Elliott | |
| 2002/0087167 | A1 | 7/2002 | Winitsky | |
| 2003/0188444 | A1 | 10/2003 | Ferraro | |
| 2007/0066919 | A1 * | 3/2007 | Gueret | 601/138 |

* cited by examiner

*Primary Examiner* — Quang D Thanh

(57) ABSTRACT

A massaging and exfoliating razor cover preferably including a deformably resilient body that may have a slot formed therein. Such a slot may be adapted to be positioned over a razor head of the existing razor. In this manner, the body may be stretched to a tensioned position when placed over the razor head of the existing razor. The body may further include a plurality of protrusions extending outwardly from the body, and a ridge extending outwardly from the body. Notably, the protrusions and ridge are suitably positioned on the body such that the protrusions and ridge independently engage the skin surface and thereby independently massage and exfoliate the skin surface respectively.

15 Claims, 7 Drawing Sheets

MASSAGING AND EXFOLIATING RAZOR COVER APPARATUS AND ASSOCIATED METHOD

CROSS REFERENCE TO RELATED APPLICATIONS

This application claims the benefit of U.S. Provisional Application No. 61/185,222, filed Jun. 9, 2009, the entire disclosures of which are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention generally relates to skin care and personal grooming products, and more particularly, to a massaging and exfoliating razor cover for providing a user with an effective means of massaging and exfoliating their skin.

2. Prior Art

Currently, millions of people use a wide variety of products and procedures to improve the appearance of their skin. For example, personal hygiene products such as alpha-hydroxy acids, RETIN-A® and RENOVA® manufactured by Ortho Dermatological in Puerto Rico, and facial scrubs enable a person to exfoliate their skin. This exfoliation process enables a person to remove dead skin cells. Although products such as those listed above are generally sufficient, more effective treatments are available. One such treatment is microderm abrasion. In microderm abrasion, micro-crystals are vacuumed through a hand piece and directed at an angle onto an area of the patient's skin. Using microderm abrasion, a skin-care technician can affect a superficial skin polishing.

Microderm abrasion treatments are known to be lengthy and expensive sessions. For example, a single microderm abrasion session typically can last thirty minutes. Moreover, microderm abrasion treatments can cost more than $90. Thus, what is needed is a simple, cost-effective solution for performing skin exfoliation.

Accordingly, a need remains for an apparatus in order to overcome the above-noted shortcomings. The present invention satisfies such a need by providing a massaging and exfoliating razor cover that is convenient and easy to use, lightweight yet durable in design, versatile in its applications, and designed for providing a user with an effective means of massaging and exfoliating their skin.

BRIEF SUMMARY OF THE INVENTION

In view of the foregoing background, it is therefore an object of the present invention to provide a massaging and exfoliating razor cover for use with an existing razor for rejuvenating a skin surface. These and other objects, features, and advantages of the invention are provided by a massaging and exfoliating razor cover preferably including a deformably resilient body that may have a slot formed therein. Such a slot may be adapted to be positioned over a razor head of the existing razor. In this manner, the body may be stretched to a tensioned position when placed over the razor head of the existing razor. The body may further include a plurality of protrusions extending outwardly from the body, and a ridge extending outwardly from the body.

Notably, the protrusions and ridge are suitably positioned on the body such that the protrusions and ridge independently engage the skin surface and thereby independently massage and exfoliate the skin surface respectively.

In one embodiment, the protrusions may be linearly aligned in a plurality of rows and juxtaposed along a top face of the body and thereby uniformly massage the skin surface.

In one embodiment, the protrusions may be vertically offset and equidistantly spaced from each other so that a plurality of gaps are defined between the protrusions respectively. In this manner, a bottom row of the protrusions may be centrally aligned between corresponding ones of the gaps defined by a top row of the protrusions.

In one embodiment, the slot may be formed along a rear section of the body. Such a body is advantageously maintained at the tensioned position while the protrusions and the ridge are adapted to massage and exfoliate the skin surface.

In one embodiment, each of the protrusions and the ridge are monolithically formed with a top surface of the body. In particular, the protrusions may be oriented along a first face of the top surface while the ridge may be oriented along a second face of the top surface. Notably, the second face slopes away from the first face and is obliquely angled relative to the first face.

In one embodiment, the second face may be either a posterior face or an anterior face of the body while the second face may be medially positioned between the posterior and anterior faces.

In one embodiment, the protrusions may be coextensively shaped.

The present invention may further include a method of utilizing a massaging and exfoliating razor cover with an existing razor for rejuvenating a skin surface. Such a method preferably includes the chronological steps of: providing a deformably resilient body having a slot formed in the body, a plurality of protrusions extending outwardly from the body, and a ridge extending outwardly from the body; stretching the body to a tensioned position and thereby positioning the slot over a razor head of the existing razor such that the body covers the razor head of the existing razor; and the protrusions and ridge independently engaging the skin surface and thereby independently massaging and exfoliating the skin surface respectively.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

Figure 1:
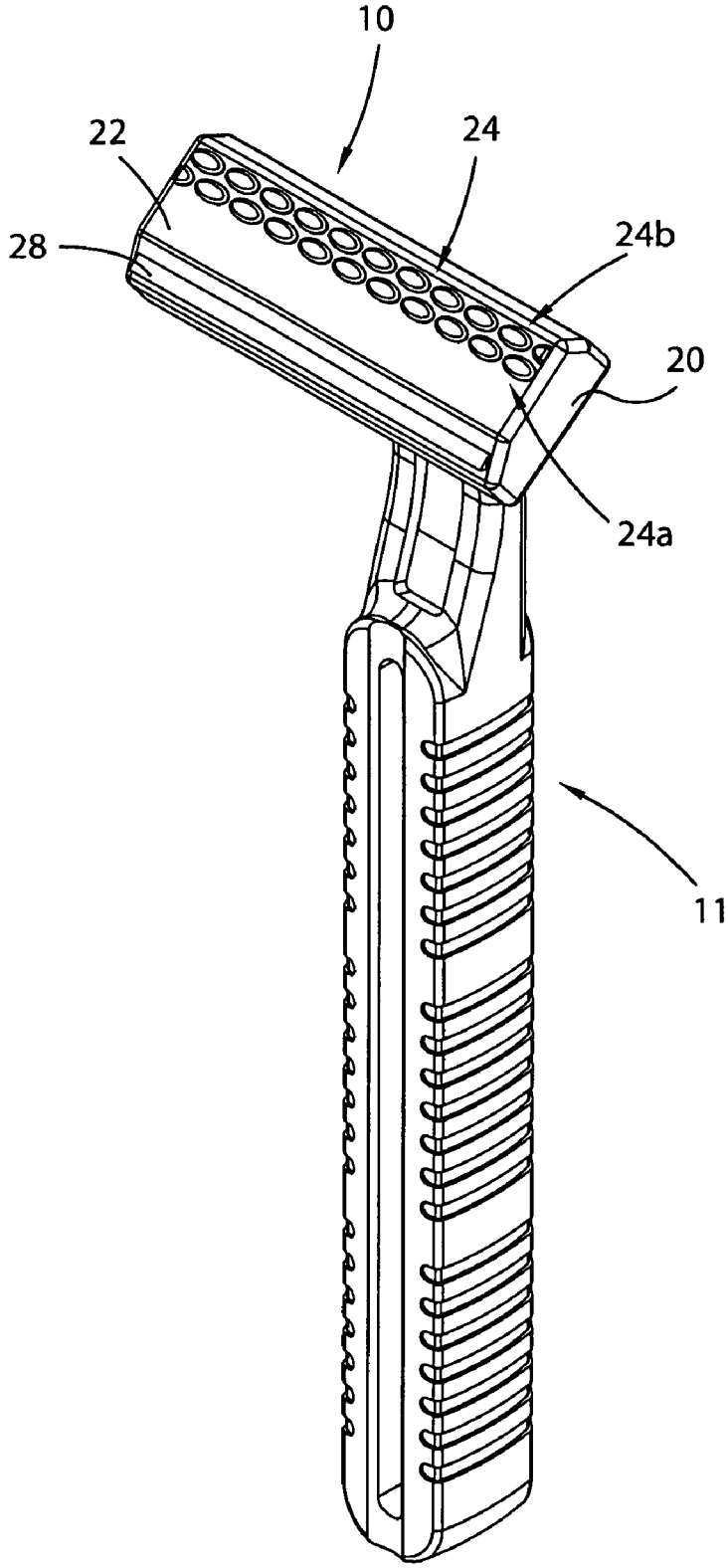
FIG. 1 is a front perspective view showing a massaging and exfoliating razor cover positioned over a razor head of the razor, in accordance with the present invention.
Figure 2:
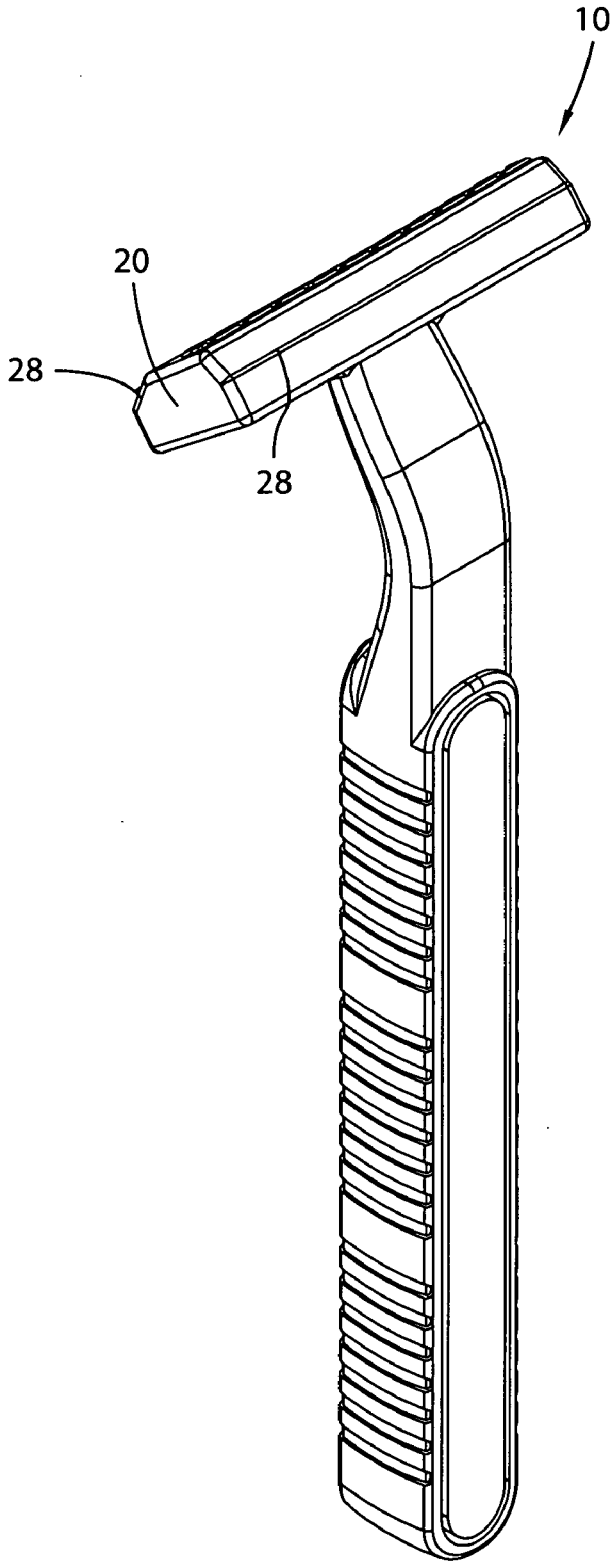
FIG. 2 is a rear perspective view of the razor cover showing a ridge positioned on a rear section of the body.
Figure 3:
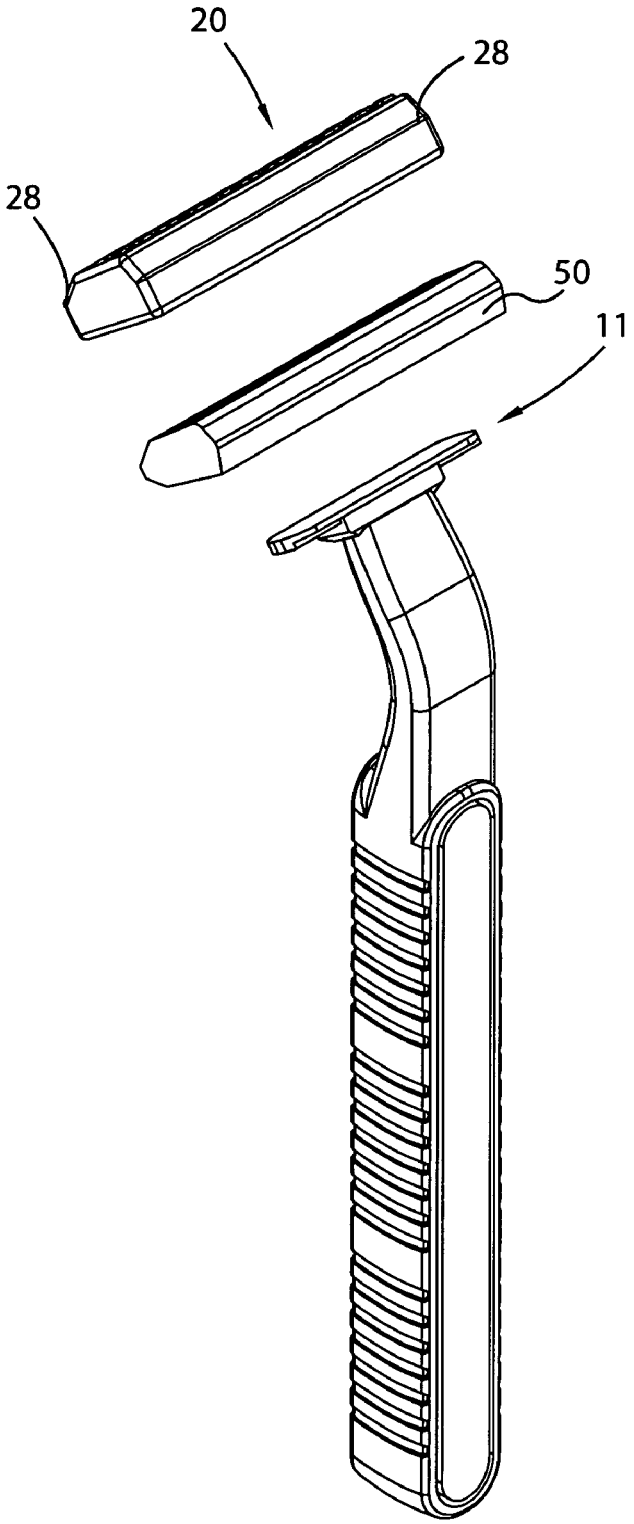
FIG. 3 is a perspective view showing the body of the cover removed from the razor head, which is detached from the razor.
Figure 4:
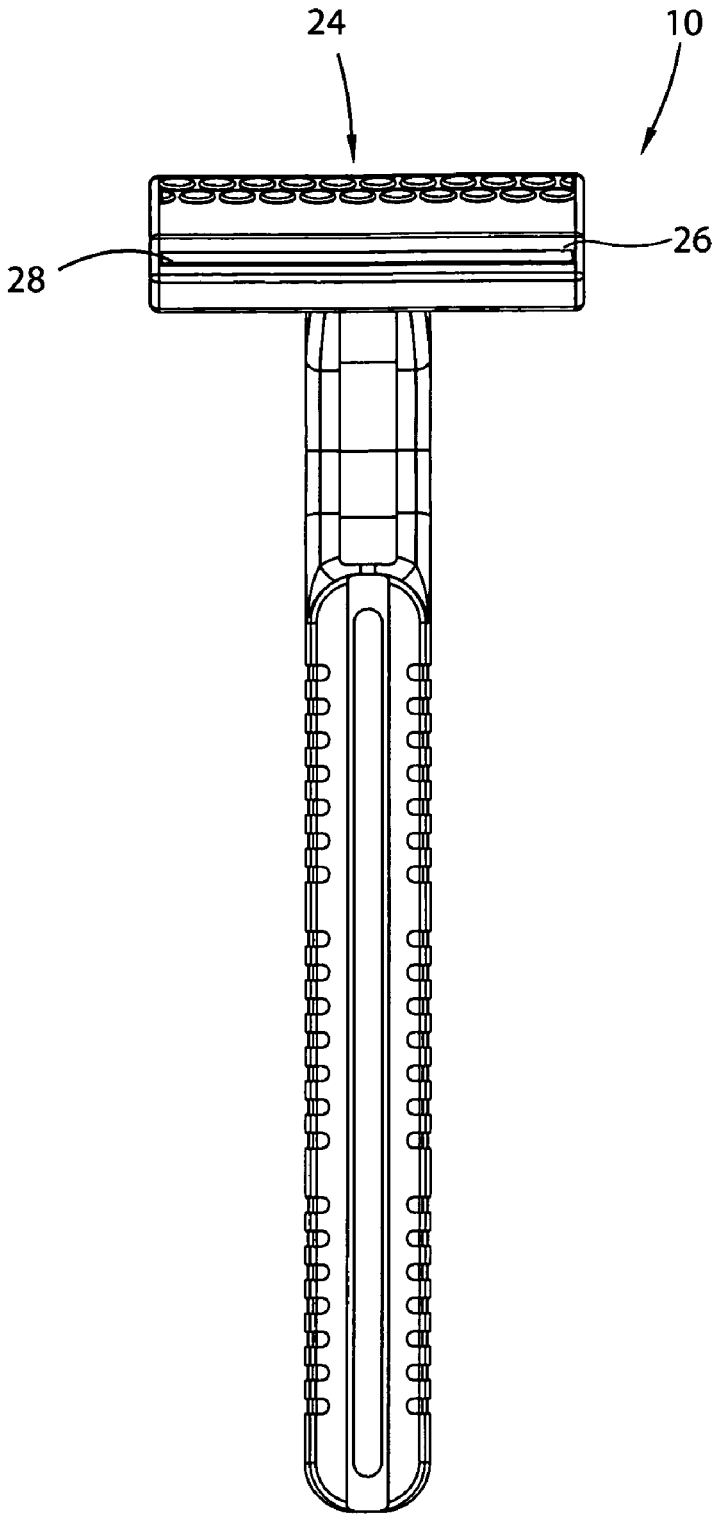
FIG. 4 is a front elevational view showing the massaging and exfoliating razor cover.
Figure 5:
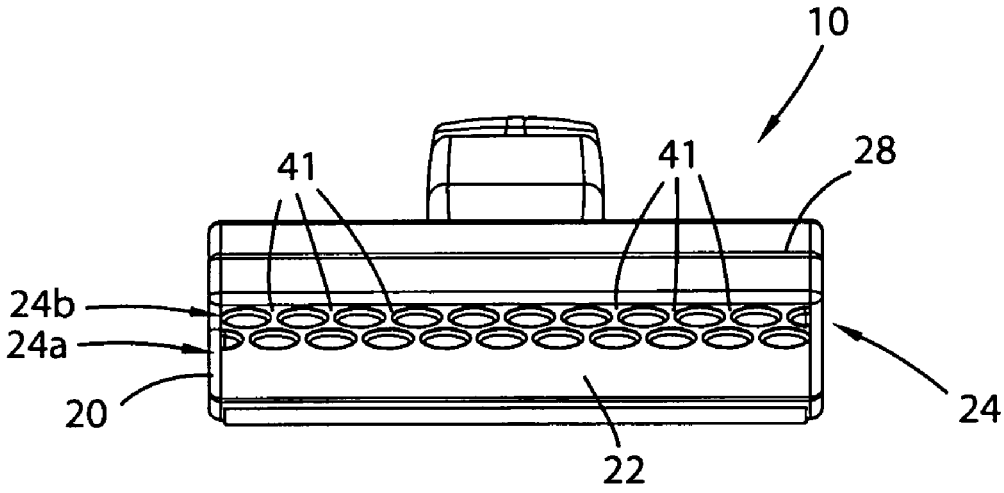
FIG. 5 is a top elevational view showing the massaging and exfoliating razor cover.
Figure 6:
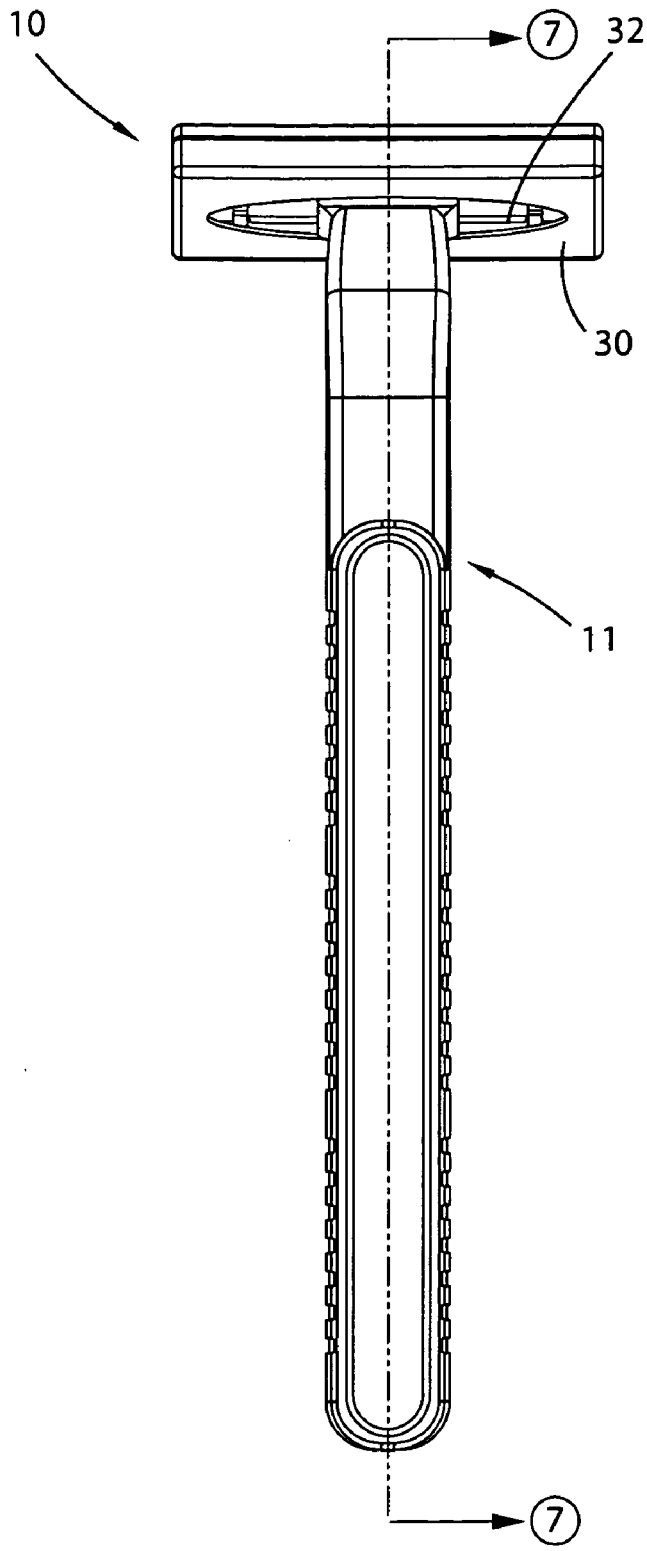
FIG. 6 is a rear elevational view showing the massaging and exfoliating razor cover.
Figure 7:
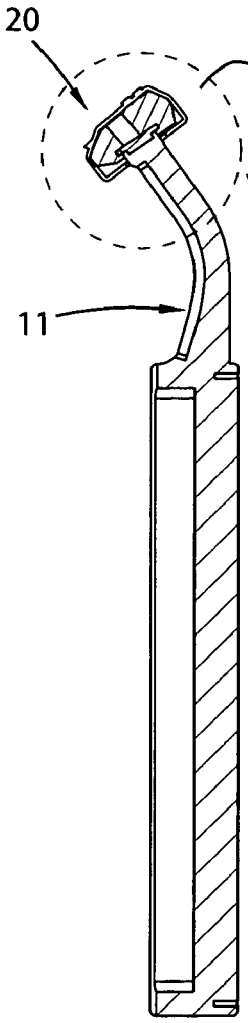
FIG. 7 is a cross-sectional view taken along line 7-7 in FIG. 6.

Those skilled in the art will appreciate that the figures are not intended to be drawn to any particular scale; nor are the figures intended to illustrate every embodiment of the invention. The invention is not limited to the exemplary embodiments depicted in the figures or the shapes, relative sizes or proportions shown in the figures.

DETAILED DESCRIPTION OF THE INVENTION

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The illustrations of the embodiments described herein are intended to provide a general understanding of the structure of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. Additionally, the illustrations are merely representational and may not be drawn to scale. Certain proportions within the illustrations may be exaggerated, while other proportions may be minimized. Accordingly, the disclosure and the figures are to be regarded as illustrative rather than restrictive.

One or more embodiments of the disclosure may be referred to herein, individually and/or collectively, by the term "present invention" merely for convenience and without intending to voluntarily limit the scope of this application to any particular invention or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, will be apparent to those of skill in the art upon reviewing the description.

The Abstract of the Disclosure is provided to comply with 37 C.F.R. §1.72(b) and is submitted with the understanding that it will not be used to interpret or limit the scope or meaning of the claims. In addition, in the foregoing Detailed Description, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all of the features of any of the disclosed embodiments. Thus, the following claims are incorporated into the Detailed Description, with each claim standing on its own as defining separately claimed subject matter.

The below disclosed subject matter is to be considered illustrative, and not restrictive, and the appended claims are intended to cover all such modifications, enhancements, and other embodiments which fall within the true scope of the present invention. Thus, to the maximum extent allowed by law, the scope of the present invention is to be determined by the broadest permissible interpretation of the following claims and their equivalents, and shall not be restricted or limited by the foregoing detailed description.

The apparatus of this invention is referred to generally in FIGS. 1-8 and is intended to provide a massaging and exfoliating razor cover. It should be understood that the present invention may be used to massage and exfoliate many different parts of the body, and should not be limited to the uses described herein.

Referring to FIGS. 1-8 in general, a massaging and exfoliating razor cover 10 is illustrated for use with an existing razor 11 to rejuvenate a skin surface such as a user's legs, arms, shoulders, etc. The cover 20 preferably includes a deformably resilient body 20 that may be manufactured from rubber or other durable and/or elastic material that provides surface area friction with a user's skin.

The body 20 preferably has a slot 32 formed therein. Such a slot 32 may be stretched and firmly positioned over a razor head 50 of the existing razor 11. In this manner, the body 20 may be stretched to a tensioned position when placed over the razor head 50 of the existing razor 11. In one embodiment, slot 32 may be formed along a rear section 30 of body 20. Such a body 20 is advantageously maintained at the tensioned position while the protrusions 24 and the ridge 28 are adapted to massage and exfoliate the skin surface. The combination of such claimed elements provides an unpredictable and unexpected benefit of permitting slot 32 to receive the razor head 50 of the razor 11 so a maximum surface area of body 20 remains firmly gripped with the razor head 50 thereby preventing undesirable rotation of body 20 during rolling motions over the user's skin.

The body 20 may further include a plurality of protrusions 24 extending outwardly from the body 20, and at least one ridge 28 extending outwardly from the body 20. Such protrusions 24 may be deformably resilient so the user can firmly press and massage his/her skin. In one embodiment, the protrusions 24 may be linearly aligned in a plurality of rows 24*a*, 24*b* and juxtaposed along a top surface 22 of body 20, thereby uniformly massaging the skin surface. In one embodiment, protrusions 24 may be vertically offset and equidistantly spaced from each other so that a bottom row 24*a* of protrusions 24 line up between corresponding gaps 41 defined by a top row 24*b* of the protrusions 24. The combination of such claimed elements provides an unpredictable and unexpected benefit of suitably arranging the protrusions 24 and ridge 28 on body 20 such that protrusions 24 and ridge 28 independently engage the skin surface and thereby independently massage and exfoliate the skin surface respectively.

As an example, a user may slide body 20 of cover 10 over the razor head 50 by inserting the existing razor head 11 into the slot 32 on the rear section 30 of the body 20. The user may then rub the protrusions 24 on their skin to exfoliate the skin. The user may then use the firm ridge 28 to massage and smooth the skin.

In one embodiment, each of the protrusions 24 and the ridge 28 are monolithically formed with a top surface 22 of the body 20. In particular, the protrusions 24 may be oriented along a first face 56 of the top surface 22 while the ridge 28 may be oriented along a second face 26, 66 of the top surface 22. Notably, the second face 26, 66 slopes away from the first face 56 and is obliquely angled relative to the first face 56. In this manner, the user can independently engage the protrusions 24 over their skin to exfoliate their skin or independently rub the ridge 28 along their body 20 to massage and smooth the skin. The combination of such claimed elements provides an unpredictable and unexpected benefit of separately and independently engaging either the protrusions 24 or ridge 28 against the skin surface in a controlled manner without undesirably aggravating or irritating the skin surface due to simultaneous contact with the protrusions 24 and ridge 28.

Figure 8:
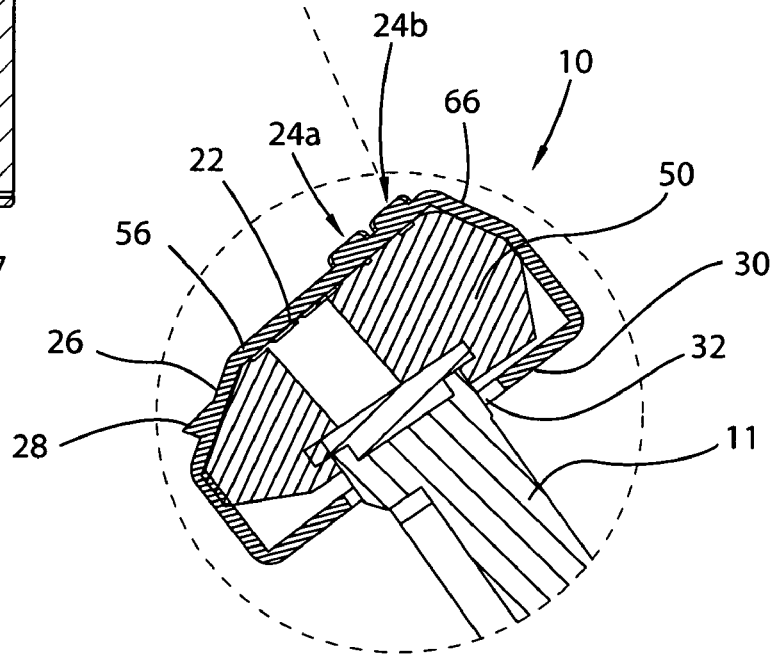
FIG. 8 is an enlarged view of section 8 identified in FIG. 7 wherein the various positions of the protrusions and ridges are shown relative to the corresponding faces of the body top surface.

In one embodiment, the second face 26, 66 may be either a posterior face (identified at 26) or an anterior face (identified at 66) of body 20 while the first face 56 may be medially positioned between the posterior and anterior faces 26, 66, as perhaps best shown in FIG. 8.

In one embodiment, the protrusions 24 may be coextensively shaped to provide uniform pressure and exfoliation along the skin surface.

In one embodiment, the cover 10 may include a body 20 that is formed from rigid plastic and has a predefined shape that may be snap-locked or slidably engaged over the existing razor head 50. Such a body 20 is suitably sized and shaped to form-fit over the razor head 50.

In one embodiment, the body 20 may be used independently of the razor head 50. Thus, razor head 50 is detached from the razor handle 11. Body 20 is then attached to the razor handle 11 in lieu of the razor head 50. Such an embodiment is preferably formed from suitably durable material for maintaining a predetermined shape. Also, a fastener is attached to the rear side of the body 20 for attaching to the razor handle 11.

In an alternative embodiment, the cover 10 may feature interchangeable protrusions 24 that are adhesively affixed, for example, so that a user can employ various sized and shaped protrusions 24 on the top surface 22 of body 20. This embodiment would allow the user to choose different patterns each day that would help to ensure that the exfoliation covers all parts of the skin.

The present invention may further include a method of utilizing a massaging and exfoliating razor cover 10 with an existing razor 11 for rejuvenating a skin surface. Such a method preferably includes the chronological steps of: providing a deformably resilient body 20 having a slot 32 formed in the body 20, a plurality of protrusions 24 extending outwardly from the body 20, and a ridge 28 extending outwardly from the body 20; stretching the body 20 to a tensioned position and thereby positioning the slot 32 over a razor head 50 of the existing razor 11 such that the body 20 covers the razor head 50 of the existing razor 11; and the protrusions 24 and ridge 28 independently engaging the skin surface and thereby independently massaging and exfoliating the skin surface respectively. The combination of such claimed elements provides an unpredictable and unexpected benefit of separately and independently engaging either the protrusions 24 or ridge 28 against the skin surface in a controlled manner without undesirably aggravating or irritating the skin surface due to simultaneous contact with the protrusions 24 and ridge 28.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation.

What is claimed as new and what is desired to secure by Letters Patent of the United States is:

1. A massaging and exfoliating razor cover for use with an existing razor for rejuvenating a skin surface, said massaging and exfoliating razor cover comprising:

a body having a slot formed therein, said slot being adapted to be positioned over a razor head of the existing razor, said body being stretched to a tensioned position when adapted to be placed over the razor head of the existing razor, said body including a plurality of protrusions extending outwardly from said body, and a ridge extending outwardly from said body;

wherein said protrusions and ridge are capable of independently engaging the skin surface and thereby independently massaging and exfoliating the skin surface respectively.

2. The massaging and exfoliating razor cover of claim 1, wherein said protrusions are linearly aligned in a plurality of rows and juxtaposed along a top face of said body and thereby capable of uniformly massaging the skin surface.

3. The massaging and exfoliating razor cover of claim 1, wherein said protrusions are vertically offset and equidistantly spaced from each other so that a plurality of gaps are defined between said protrusions respectively, a bottom row of said protrusions being centrally aligned between corresponding ones of said gaps defined by a top row of said protrusions.

4. The massaging and exfoliating razor cover of claim 1, wherein said slot is formed along a rear section of said body, said body being maintained at said tensioned position while said protrusions and said ridge are adapted to massage and exfoliate the skin surface.

5. The massaging and exfoliating razor cover of claim 1, wherein each of said protrusions and said ridge are monolithically formed with a top surface of said body, each of said protrusions being oriented along a first face of said top surface, said ridge being oriented along a second face of said top surface, wherein said second face slopes away from said first face and is obliquely angled relative to said first face.

6. The massaging and exfoliating razor cover of claim 5, wherein said second face is one of a posterior face and an anterior face of said body while said first face is medially positioned between said posterior and anterior faces.

7. The massaging and exfoliating razor cover of claim 1, wherein said protrusions are coextensively shaped.

8. A massaging and exfoliating razor cover for use with an existing razor for rejuvenating a skin surface, said massaging and exfoliating razor cover comprising:

a deformably resilient body having a slot formed therein, said slot being adapted to be positioned over a razor head of the existing razor, said body being stretched to a tensioned position when adapted to be placed over the shaving head of the existing razor, said body including a plurality of protrusions extending outwardly from said body, and a ridge extending outwardly from said body;

wherein said protrusions and ridge are capable of independently engaging the skin surface and thereby independently massaging and exfoliating the skin surface respectively.

9. The massaging and exfoliating razor cover of claim 8, wherein said protrusions are linearly aligned in a plurality of rows and juxtaposed along a top face of said body and thereby capable of uniformly massaging the skin surface.

10. The massaging and exfoliating razor cover of claim 9, wherein said protrusions are vertically offset and equidistantly spaced from each other so that a plurality of gaps are defined between said protrusions respectively, a bottom row of said protrusions being centrally aligned between corresponding ones of said gaps defined by a top row of said protrusions.

11. The massaging and exfoliating razor cover of claim 10, wherein said slot is formed along a rear section of said body, said body being maintained at said tensioned position while said protrusions and said ridge are adapted to massage and exfoliate the skin surface.

12. The massaging and exfoliating razor cover of claim 11, wherein each of said protrusions and said ridge are monolithically formed with a top surface of said body, each of said protrusions being oriented along a first face of said top surface, said ridge being oriented along a second face of said top surface, wherein said second face slopes away from said first face and is obliquely angled relative to said first face.

13. The massaging and exfoliating razor cover of claim 12, wherein said second face is one of a posterior face and an anterior face of said body while said first face is medially positioned between said posterior and anterior faces.

14. The massaging and exfoliating razor cover of claim 13, wherein said protrusions are coextensively shaped.

15. A method of utilizing a massaging and exfoliating razor cover with an existing razor for rejuvenating a skin surface, said method comprising the chronological steps of:

providing a deformably resilient body having a slot formed therein, said body including a plurality of protrusions extending outwardly from said body, and a ridge extending outwardly from said body;

stretching said body to a tensioned position and thereby positioning said slot over a razor head of the existing razor such that said body covers the razor head of the existing razor; and said protrusions and ridge independently engaging the skin surface and thereby independently massaging and exfoliating the skin surface respectively.

* * * * *